United States Patent [19]

Schoonman

[11] 4,045,961

[45] Sept. 6, 1977

[54] CONTROL OF FREEZING IN AIR-COOLED STEAM CONDENSERS

[75] Inventor: Willem Schoonman, Wyckoff, N.J.

[73] Assignee: The Lummus Company, Bloomfield, N.J.

[21] Appl. No.: 591,677

[22] Filed: June 30, 1975

Related U.S. Application Data

[63] Continuation-in-part of Ser. No. 504,243, Sept. 9, 1974, abandoned.

[51] Int. Cl.[2] ..... F28B 11/00

[52] U.S. Cl. ..... 60/686; 60/690; 165/111; 165/32; 165/DIG. 1

[58] Field of Search ..... 165/110, 111, 1, 32, 165/96, DIG. 1; 60/690–693

[56] References Cited

U.S. PATENT DOCUMENTS

| | | | |
|---|---|---|---|
| 3,259,177 | 7/1966 | Niemann | 165/34 |
| 3,760,871 | 9/1973 | Larinoff | 165/110 |

*Primary Examiner*—Albert W. Davis, Jr.
*Attorney, Agent, or Firm*—Alice L. Chen

[57] ABSTRACT

Damage to steam condensers resulting from freezing of condensate when operating at below freezing ambient air temperature and at low steam flow rates and/or low ambient temperatures is prevented by causing air or other non-condensible inert gas or gases to accumulate in tubes and/or headers of the condenser for a period of time sufficient to substantially lower the heat transfer capacity of the condenser but insufficient to cause damage due to freezing of condensate. The accumulation is caused by shutting off the air takeoff from condensate headers and/or introducing additional air or other non-condensible gas into the apparatus for a controlled, predetermined period of time.

20 Claims, 1 Drawing Figure

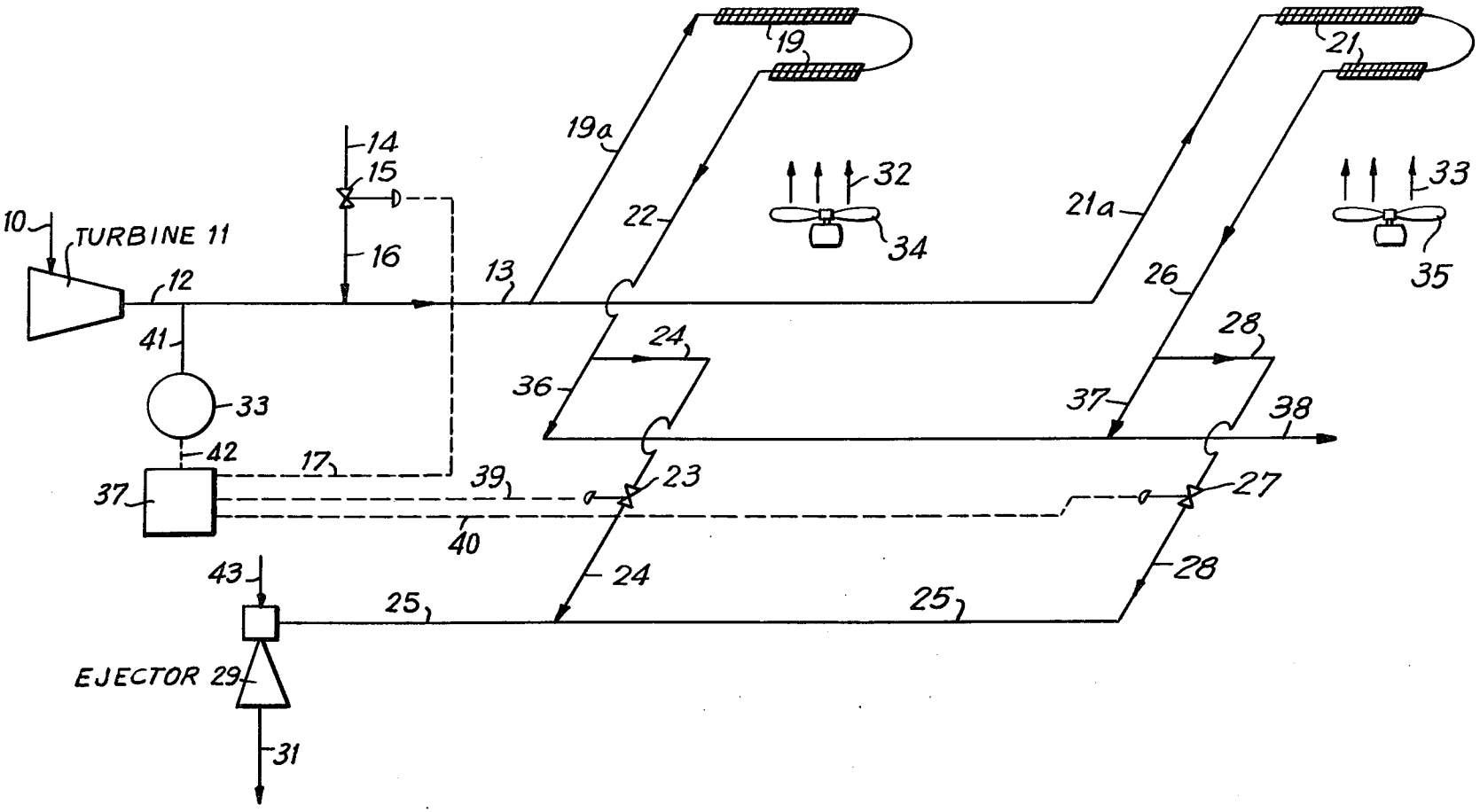
TURBINE 11
EJECTOR 29

CONTROL OF FREEZING IN AIR-COOLED STEAM CONDENSERS

CROSS REFERENCE

This is a continuation-in-part application with respect to my co-pending U.S. patent application Ser. No. 504,243, which was filed on Sept. 9, 1974, now abandoned.

BACKGROUND AND PRIOR ART

Air-cooled condensers, for example air-cooled steam condensers, are designed for full load operating capacity at relatively high ambient air temperature. During part of the time, however, such units may have to operate at low load and ambient air temperatures below the freezing temperature of the condensate, or at low ambient air temperatures. During such a period, the problem of freezing of condensate may arise. The possibilities and dangers of ice formation in the operation of air-cooled steam condensers have been the subject of numerous studies, investigations, patents and articles for quite some time. This subject has been of particular importance during the past 15 years or so, due to the increasing use of air-cooled heat exchangers for cooling and condensing steam or water vapor in chemical plants and refineries and for cooling water or condensing steam in large power plants. In the design of air-cooled steam condensers, therefore, it is necessary in many cases to provide means to prevent or at least lessen the possibility of damage to the tubes of the condensers resulting from ice formation.

As is well known, the danger of freezing of condensate in such equipment is of greatest concern in two situations: at higher than design heat transfer rates and at low steam flow rates. As those skilled in the art will realize, we are at all times herein concerned with ambient temperatures at or below the freezing point of water. The former situation may result from local prevalent weather conditions which engender low ambient air temperatures or unusually strong winds, or both; these may be encountered regularly and for long periods of time in some regions. The latter situation may occur in any installation because of factors such as partial shutdown of equipment or variations in the amount of steam produced.

Some approaches taken to deal with this problem have concentrated on designing an air-cooled steam condenser with structural features which would serve to control the condensation of steam so as to prevent or at least lessen the likelihood of ice formation. Thus, for example, it has been suggested to provide valves on condensate drains to prevent backing up of condensate which could conceivably cause ice formation, to provide separate manifolds for each row of condenser tubes to prevent backing up of condensate from one row of tubes into another row at a higher level, to provide different types of fins on the tubes of different rows of the steam condenser, or to provide some tubes with fins along only a portion of their length to equalize heat transfer, and to provide small tubes within the main tubes for removing condensate at a portion of the tubes between the steam inlet manifold and the condensate outlet manifold. Numerous other special designs have been proposed to achieve the aim of preventing freezing of condensate. Others have approached the problem from the aspect of controlling the air flow over the tubes and have provided fan controls of various types responsive to one or more conditions in the system to lessen the air flow over the tubes when the steam flow through the condenser is low, as otherwise too high a heat transfer rate would be effected between the large quantity of external cooling air and the small quantity of steam in the tubes, and ice formation within the tubes could result. Thus, systems have been proposed for shutting fans off, for lowering their speed, for changing the pitch of the fan blades, for covering the tube surfaces with movable baffles, and for otherwise controlling the amount of cooling air flowing over the tubes.

In situations in which low ambient temperatures or varying steam flow rates at below freezing temperatures are anticipated, it has become quite common to provide fan control systems (usually responsive to some thermal condition in the system) to either lower the speed of one or more fans or shut them down entirely until the normal flow of cooling air is again required. Thus, the lowering of fan speed or shutting down of fans decreases the quantity of cooling air flowing over the tubes of the condensers and will often prevent ice formation which could otherwise occur in such conditions due to an excessive heat transfer rate. However, even with fans shut off, there may still be an appreciable flow of cooling air over the tubes of the condensers due to either wind effects or natural convection currents, and thus the danger of freezing of condensate may still exist, especially when the flow of steam is quite below the normal rate.

In natural draft cooling towers, the admission of the cooling air is usually controlled by louvres or shutters, but air may still enter the cooling tower even when these are closed, and again there is the danger of freezing of condensate in this situation, when a low steam flow rate exists in one or more of the condenser units concurrently with air temperatures below the freezing temperature of the condensate.

OBJECTS OF THE INVENTION

It is an object of the present invention to provide a system and method for prevention of freezing in air-cooled steam condensers.

It is a further object of the present invention to provide a system and method for prevention of freezing in air-cooled steam condensers operating at low ambient temperatures or under reduced steam flow rates at ambient temperatures at or below the freezing temperature of the condensate. Another object of this invention is to provide a system and method for prevention of freezing in air-cooled steam condensers under emergency shut-off conditions.

Yet another object of the present invention is to provide a system and method for prevention of freezing in air-cooled steam condensers operating under forced draft, when the fans providing air for such condensers are not operating.

Yet another objective of the present invention is to provide a method and system for prevention of freezing in air-cooled steam condensers in natural draft cooling towers.

THE DRAWING

Reference will hereinafter be made to the accompanying drawing which is a schematic representation of an embodiment of this invention, and the ensuing description which will facilitate a better understanding of the present invention.

SUMMARY OF THE INVENTION

In brief, the invention herein comprises a method of controlling the operation of an air-cooled steam condenser comprising causing non-condensible inert gas to accumulate in the condenser for a pre-determined time and in a pre-determined quantity sufficient under the conditions present in the condenser to substantially lower the heat transfer capacity of the condenser but insufficient to cause damage to the condenser from freezing of condensate therein.

Additionally, the invention herein comprises, in an air-cooled steam condenser, means for causing the accumulation of non-condensible gases in the condenser for a predetermined time and predetermined amount to substantially lower the heat transfer capacity of the condenser but insufficient to cause damage to the condenser from freezing of condensate therein. Cooling air may be provided by a forced draft system or by a natural draft system.

In another embodiment of the invention, means are provided for connecting the non-condensible gas takeoff means to the mass for introducing non-condensible gas into the condenser and a valve is provided in the takeoff means for selectively causing non-condensible gas removed from the condenser to be reintroduced into the condenser Additionally, the invention comprises a system for performing the foregoing method comprising the aforedescribed steam condenser, a steam turbine from which steam is supplied, means for sensing the turbine back pressure and means for automatically causing such accumulation of non-condensible inert gases to occur in the condenser responsive to a drop in turbine back pressure below a predetermined value.

DETAILED DESCRIPTION OF THE INVENTION

A steam condenser of the type contemplated herein consists generally of a steam header for receiving steam from a turbine or other source, a series of tubes connected at one end to a steam header or to a steam subheader thereof and, at the other end to one or more condensate headers for receiving and collecting condensate formed in the tubes by condensation of steam resulting from the passage of ambient air across the tube surfaces. Attached to the condensate header, or to a condensate sub-header thereof, is a means for removing air or other non-condensible gases, such as nitrogen, from the system, which generally consists of a pipe connected at one end to the condensate header and at the other end to a vacuum jet ejector system. Ambient air is caused to pass over the tube surfaces, either by one or more fans or by natural draft convection currents. Alternatively, the condensate header may be connected to a second steam condensing unit, that is, an after-condenser, of similar or different construction, for condensation of uncondensed steam and/or subcooling of the condensate using either the same or a second current of air. In such a case, the removal of air and other non-condensible gases is accomplished by a pipe or other removal means connected to the header of the after-condenser, similarly attached to a vacuum ejector system. When an after-condenser is employed, non-condensible gases are usually removed from both the main condenser and the after-condenser at this point.

The condensate may be returned to a boiler for production of steam, e.g. to drive a steam turbine. The steam exhausted from the turbine is again passed through the condenser. The air and non-condensible gases are vented to the atmosphere from the vacuum jet ejector system or they may be reintroduced into the condenser.

In the operation of air-cooled condensers in general, it is felt to be not only desirable, but necessary, to continuously remove air and other non-condensible gases from the condenser system, as it is otherwise thought that, particularly at low steam flow rates, the presence of such non-condensible gases (including air) could cause the formation of gas pockets, which would impede the flow of steam and/or condensate in the tubes, resulting in at least partial blockage of the tubes due to blanketing with air and other non-condensible gases, followed by sub-cooling and freezing of the condensate therein. Consequently, the present invention, involving the causing of accumulation of air and/or other non-condensible gases for a limited period of time in the condenser or a section thereof, to reduce the heat transfer capability of the equipment, is contrary to the general practice in the art.

Given the operating conditions, such as heat transfer rate and ambient temperatures, all of which are known to the designer, together with known quanitites such as heat of condensation of steam and physical properties of ice, the time necessary for formation of an ice layer in the tubes sufficient to effectively block flow of steam and/or condensate through the tubes can be readily calculated. Such calculation is performed by the designer during the design of the heat exchanger, and the control system is designed to utilize the invention by causing accumulation of air or other non-condensible gases for a period of time approaching that calculated as necessary for formation of such an ice layer, less an appropriate safety factor. The accumulation of air or other non-condensible gases in the condenser results in reduction of the partial pressure of the steam, thereby reducing its saturation temperature, and, generally, also reducing the heat transfer coefficient in the tubes. In such a fashion, condensation of the steam will still occur, without the danger of excessive heat transfer. When a particular situation is attained in the system as is described below, the method of the present invention is put into effect, that is, air and/or non-condensible gases are caused to accumulate in the condenser for the calculated time.

In one mode of operation of the present invention, air or other non-condensible gases would be allowed to accumulate in a section of the condenser thereby reducing the heat transfer capability of that section. However, even though the heat transfer capability of a section is greatly reduced because of blanketing with non-condensible gas, there will still be some migration of steam into that section from the main steam header and some condensation of steam will occur. It is theorized that, because of the low heat transfer rate occurring in the tubes of that particular section and because of ambient temperatures below that of the freezing point of water, at least some freezing of condensate will occur in the tubes of that section.

While a section of the condenser has been operating at a reduced heat transfer rate, due to controlled accumulation of non-condensible gases, the remaining sections of the condenser have been operating at a correspondingly increased load, as a result of which, any previously accumulated ice will be defrosted and leave with the condensate.

After a period of time, before ice has accumulated to the point of blocking the first mentioned section, non-condensible gas is introduced into one or more of the remaining sections of the condenser, and the non-condenser gas which had blanketed the first section of the condenser is withdrawn, by means of an ejector, for example, thereby shifting more heat transfer duty to the first section and defrosting any accumulated ice therein. This procedure of alternately blanketing sections of the condenser with non-condensible gas followed by removal of the non-condensible gas may be repeated on a cyclical basis, thereby preventing condensate freezing problems from occurring over a period of time.

DETAILED DESCRIPTION OF DRAWING

Referring now to the drawing in detail, steam at elevated pressure is introduced to a steam turbine 11 by means of line 10. The steam is expanded in the turbine and exits via line 12. It then flows to a main steam header 13. A controlled quantity of air or other non-condensible gas enters steam header 13 through line 14. The quantity of air and non-condensible gas flowing into steam header 13 is controlled by a valve 15 located in line 14. Gas from valve 15, flows via a conduit 16 to steam header 13, where it mixes with the steam flowing therein.

Steam header 13 is generally connected to multiple banks of condenser tubes, herein shown as two banks, a bank 19 and a bank 21, for simplicity and clarity of explanation. During normal operation, bank 19 is cooled by ambient air 32 blown across the face of its tubes by a fan 34, and bank 21 is cooled by ambient air 33, blown across the face of its tubes by a fan 35.

For purposes of this illustration, it is assumed that fan 34 has been shut off because of low heat duty and that below freezing ambient air temperatures prevail. Circulation of ambient air about the tubes of bank 19 will be by natural convection currents.

Air and non-condensible gas, along with steam, enter bank 19 from header 13 through line 19*a.* As the mixture of gases and steam flow through bank 19, part or all of the steam is condensed. A portion of the condensate may freeze to ice inside the tubes of bank 19 and adhere to the inner surfaces thereof.

Liquid condensate and gases exit bank 19 via a header 22. Air and non-condensible gas are withdrawn from header 22 through line 24. A valve 23 is located in line 24 to control the flow of air and non-condensible gas through line 24. For purposes of this illustration, assume that valve 23 is closed. Since valve 23 is closed, inert gases will accumulate in header 22 over a period of time and eventually blanket the tubes of tank 19 thereby restricting steam from entering bank 19 and greatly reducing the heat transfer rate therein.

Liquid condensate in bank 19 flows from header 22 to a main condensate header 38 through line 36. Header 38 contains a liquid seal which prevents air and non-condensible gases from entering line 36.

The steam in header 13, along with air and non-condensible gas, flows to bank 21 through line 21*a.* Cooling air 33, may be blown across the tubes of bank 21 by means of fan 35 or, cooling air may be allowed to circulate across the tubes of bank 21 by natural convection. The steam-air and/or steam non-condensible gas mixture flows through the tubes of bank 21 wherein the steam melts any previously accumulated ice and is itself condensed to water. Water condensate, together with air and non-condensible gas, flows into a header 26 from the tubes of bank 21. Condensate flows out to the main condensate header 38, which has a liquid seal, through line 37. Air and non-condensible gas are withdrawn from header 26 through line 28. A valve 27 is located in line 28 to control the flow of air and non-condensible gas therein. For purposes of this illustration, assume that valve 27 is open. Since valve 27 is open, air and non-condensible gas flow through valve 27 into line 28, then flow into a gas header 25 and then into an ejector 29. Ejector 29 is supplied with a motive gas, such as steam, through line 43. The air and non-condensible gas are ejected by ejector 29 into the atmosphere through line 31. A portion of all of the air and non-condensible gas in line 31 may be recycled to line 14 for reintroduction into header 13 if it is desired.

The pressure in turbine 11's exhaust line 12 is transmitted through line 41 to an instrument 33 where it is measured. The pressure is then transmitted to a controller 30 via line 42. Controller 30 controls the position of valve 15 by a signal transmitted through conduit 17. Controller 30 also controls the positions of valves 23 and 27 by signals sent through conduits 39 and 40, respectively.

As mentioned above, valve 23 is presently in the closed position while valve 27 is in the open position. After a period of time, controller 30 will act to open valve 23 and to close valve 27. Air and non-condensible gas will be exhausted from bank 19 through header 22, line 24, and header 25, and will be exhausted by ejector 29 in the manner previously described for bank 21. Steam will start flowing at a higher rate to bank 19 and bank 19 will start operating in the manner described for bank 21.

Air and non-condensible gas will then accumulate in bank 21 in the manner described for bank 19.

After a period of time, controller 30 will close valve 23 and open valve 27, thereby restoring the system to its original position in the operative cycle.

EXAMPLE

The following provides an example of the use of this invention in an air-cooled steam condenser system. Given a heat transfer coefficient of 60 BTU/hr ft$^2$ degree F and a heat of condensation of steam of 1,000 BTU/lb, it was calculated that in order to build up an ice layer $\frac{1}{8}$ of an inch thick with the fans off, 10 minutes would be required at an ambient temperature of $-40°$ F. Thus, leaving sufficient time for safety factors, it was calculated that, should it be necessary to utilize the accumulation of air or other non-condensible gas according to the present invention, such gas could be safely accumulated for up to 6 minutes. The introduction and accumulation of air and other non-condensible gas could be performed either manually, or preferably, by a preset automatic control sensing the steam turbine back pressure.

Basically, the method of the invention may be carried out in either or both of two ways. In one embodiment, a valve such as valve 23, is installed in the takeoff line leading to the vacuum jet ejector so that this line may be permitted to remain open, or may be blocked by closing the valve. Preferably, the valve is located at the connection of this line to the condensate header. Alternatively, or additionally to the above, a line, such as line 14, may be installed in or near the steam header for injecting or introducing additional amounts of air or other inert, non-condensible gases, such as nitrogen, into the steam non-condensible gas mixture as it flows into the condenser. In a preferred form of this embodiment, the air or non-condensible gas introduced into the condenser can be that removed from the condenser via the ejector system and can be recycled to the steam header. In such a case, an additional pipe would be installed in the system, connecting line 31, the outlet of the vacuum jet ejector, to line 14, the line by which non-condensible gas is introduced into the steam header. A valve or valves would be appropriately installed in this additional pipe to prevent passage of non-condensible gases through the pipe during normal operation. Nitrogen, instead of air, can be injected into the condenser should the plant operator object to the introduction of additional air into the condenser system.

The operation of the method and system of this invention is preferably controlled by sensing the back pressure of the steam from the turbine. When the back pressure drops below that permitted in the particular installation, i.e. the minimum permissible or necessary turbine back pressure, the invention is put into operation. This can be done either manually, by visual inspection of appropriate gauges, or automatically, by an appropriate control system. The amount of air and/or other non-condensible gases permitted to accumulate or injected depends on the back pressure as sensed, i.e. the lower the back pressure, the greater the amount of non-condensible gases introduced since the partial pressure of the steam will have to be reduced to a lower value and the heat transfer coefficient also reduced. At the end of the calculated time, injection or introduction of non-condensible gas is stopped and the valve on the takeoff line, e.g. valve 23, is opened to permit removal of accumulated non-condensible gas in the usual fashion.

As mentioned above, this system is most useful in preventing freezing when, in a forced draft system, the fans are off or operating at low speed. However, it is possible to utilize this system even with the fans operating at reasonable speeds, in emergencies, should the danger of freezing exist or should the turbine back pressure drop in unusual situations. In a further embodiment, the accumulation of air or non-condensible gases can be controlled individually in separate banks of steam condensers so that this method will only be operative at a given time in those portions of a steam condensing system in which a danger of freezing is present.

In some situations, particularly operation at low ambient temperatures, a single accumulation of non-condensible gas may be insufficient to satisfactorily control the back pressure of the associated steam turbine and it may be necessary to repeat the operation a substantial number of times. In such case, the defrosting period (that time in which the accumulated non-condensible gases are being removed from the condenser) must be taken into account and must be of sufficient duration to prevent the danger of excess ice formation arising from the cumulative effect of several periods of operation with non-condensible gas accumulation. Thus, the defrosting period after each period of gas accumulation should be sufficient to melt accumulated ice. This defrosting period, moreover, can be readily calculated from the available data.

In a further embodiment of this invention, particularly useful for steam condensers operating at low ambient air temperatures when the danger of freezing can be present continuously over a long period of time, the invention can be operated on a regular basis; that is, without sensing the back pressure of the turbine, the appropriate valves, such as valves 23 and 27, can be opened or closed to cause accumulation and removal of air or other non-condensible gases, on a cyclical basis, with the accumulation occurring for a period of time sufficient to maintain the unit operating at or with less than the maximum tolerable ice depositing under the circumstances, but insufficient to result in the blockage of the tubes of the condenser due to ice formation, and the length of the air and non-condensible gas removal period or defrosting period can be for a sufficient time to offset the effects of the accumulation period.

Additionally, as with the previous embodiments, the accumulation and removal of air can be set to operate automatically at preselected periods of time calculated to achieve the objectives of this invention.

In general, the method and system of this invention will not be utilized as the primary freeze-control prevention system in an air-cooled steam condenser installation, but will serve as as auxiliary and back-up system to a fan control system, operating generally only when the fans are off or operating at low speed. However, as pointed out previously, the installation of this system also provides an emergency control in the case of a sudden drop in steam turbine back pressure. The invention may be used in connection with any of the usual tubular, air-cooled steam condensers irrespective of the shape of the tubes or the number or type of headers employed. Examples of steam condensers with which this invention may be employed are those shown in U.S. Pat. Nos. 3,705,621, 3,677,338, 3,789,919, 3,814,177 and 3,073,575, as well as many others.

The invention can readily be installed in an existing unit since all the necessary conditions are known, thus permitting improved operation of installations in which freezing is a problem.

I claim:

1. A method of controlling the operation of an air-cooled steam condenser having a plurality of heat exchanger tubes comprising causing non-condensible inert gas to accumulate in a portion of the condenser tubes for a predetermined time and in a predetermined amount sufficient under the conditions present in the condenser to substantially lower the heat transfer capacity but insufficient to allow damage to occur to the condenser from freezing of condensate therein.

2. A method according to claim 1 wherein the accumulation of non-condensible gas is caused by blocking the exit of such gas from the condenser.

3. A method according to claim 1 wherein the accumulation of non-condensible gas in the condenser tubes is caused by introducing a non-condensible gas into the steam flowing into the condenser.

4. A method according to claim 3 wherein the non-condensible gas is removed from the condenser and recycled for reintroduction thereinto.

5. A method according to claim 3 wherein the exit of non-condensible gas from the condenser is controllably blocked.

6. A method according to claim 1 wherein the condenser receives steam from a steam turbine, further comprising sensing the back pressure of the steam turbine and causing the accumulation of non-condensible gas in the condenser when the back pressure falls below a predetermined value.

7. A method according to claim 6 in which the accumulation of non-condensible gas is sensed and controlled automatically.

8. A method according to claim 1 further comprising removal of the accumulated non-condensible gas and defrosting of the condenser with unrestricted steam flow for a second predetermined time, followed by re-accumulation of non-condensible gas for the same predetermined time as initially performed.

9. A method according to claim 8 in which the accumulation and defrosting periods are controlled automatically.

10. A method according to claim 1 in which the condenser is cooled by a forced draft system.

11. A method according to claim 1 in which the condenser is cooled by a natural draft convection system.

12. In an air-cooled steam condenser having a steam header, a condensate header, a plurality of tubes connecting the steam header to the condensate header, means for introducing steam into the steam header, means for removing condensate from the condensate header, and takeoff means for removing uncondensed gases from the condenser, the improvement comprising means for causing the accumulation of non-condensible gases in a portion of the condenser tubes for a predetermined time and in a predetermined amount sufficient under the conditions present in the condenser to substantially lower the heat transfer capacity of the condenser but insufficient to allow damage to occur to the condenser from freezing of condensate therein.

13. A steam condenser according to claim 12 wherein the means for causing accumulation of non-condensible gases comprise valve means located in the takeoff means.

14. A steam condenser according to claim 12 wherein the means for causing accumulation of non-condensible gases comprise means for introducing such gases into the condenser.

15. A steam condenser according to claim 14 further comprising conduit means connecting the takeoff means to the means for introducing non-condensible gases into the condenser and valve means located in the takeoff means for selectively causing uncondensed gases removed from the condenser to pass through the conduit means for re-introduction into the condenser.

16. A system including a steam condenser according to claim 12 further comprising a steam turbine from which steam is supplied to the condenser, means for sensing the steam turbine back pressure and means for automatically causing the accumulation of non-condensible gases in the condenser responsive to a drop in turbine back pressure below a predetermined value.

17. A steam condenser according to claim 12 wherein cooling air is provided by a force draft system.

18. A steam condenser according to claim 12 wherein cooling air is provided by a natural draft convection system.

19. A method of controlling the operation of an air-cooled steam condenser having a plurality of sections of heat exchanger tubes comprising causing non-condensible gas to accumulate in alternate sections of the condenser followed by removal of the non-condensible gas and repetition of said alternate accumulation of gas on a cyclical basis, thereby preventing damage to the condenser resulting from freezing of condensate in the tubes over a period of time.

20. The method of claim 19 wherein the accumulation of gas in alternate sections of the condenser is for a predetermined time sufficient under the conditions present in the condenser to substantially lower the heat transfer capacity but insufficient to allow damage to occur to the condenser from freezing of condensate therein.

* * * * *